US010335834B2

(12) United States Patent
Castelli

(10) Patent No.: US 10,335,834 B2
(45) Date of Patent: Jul. 2, 2019

(54) WASTE STORAGE DEVICE AND CORRESPONDING SORTING METHOD

(71) Applicant: UZER, Paris (FR)

(72) Inventor: Clément Castelli, Paris (FR)

(73) Assignee: UZER, Paris (FR)

( * ) Notice: Subject to any disclaimer, the term of this patent is extended or adjusted under 35 U.S.C. 154(b) by 0 days.

(21) Appl. No.: 15/551,930

(22) PCT Filed: Feb. 17, 2016

(86) PCT No.: PCT/FR2016/050360
§ 371 (c)(1),
(2) Date: Nov. 17, 2017

(87) PCT Pub. No.: WO2016/132066
PCT Pub. Date: Aug. 25, 2016

(65) Prior Publication Data

US 2018/0056336 A1 Mar. 1, 2018

(30) Foreign Application Priority Data

Feb. 19, 2015 (FR) ..... 15 51419

(51) Int. Cl.
*B07C 7/00* (2006.01)
*B65F 1/00* (2006.01)

(52) U.S. Cl.
CPC ..... *B07C 7/005* (2013.01); *B65F 1/004* (2013.01); *B07C 2501/0054* (2013.01); *B65F 2001/008* (2013.01); *B65F 2210/112* (2013.01); *B65F 2210/128* (2013.01); *B65F 2210/138* (2013.01); *B65F 2210/168* (2013.01); *B65F 2210/176* (2013.01)

(58) Field of Classification Search
CPC ..... B65F 1/004; B07C 2501/00; B07C 2501/0054
USPC ..... 209/549
See application file for complete search history.

(56) References Cited

U.S. PATENT DOCUMENTS 7,080,777 B2 * 7/2006 Wagner ..... B07C 7/005 235/385
9,090,399 B2 * 7/2015 Sundholm ..... B07C 5/3412
9,790,024 B2 * 10/2017 Sundholm ..... B07C 5/3412
(Continued)

FOREIGN PATENT DOCUMENTS

CN 203889417 U 10/2014
WO WO-2010112668 A1 * 10/2010 ..... B07C 5/3412
WO WO-2010112669 A1 * 10/2010 ..... B07C 5/3412

*Primary Examiner* — Terrell H Matthews
(74) *Attorney, Agent, or Firm* — MH2 Technology Law Group, LLP

(57) ABSTRACT

A waste storage device and corresponding waste sorting method. The waste storage device may include compartments for storing waste; an acquisition unit that acquires at least one characteristic of a piece of waste that is to be stored in the waste storage device; a processor unit that obtains data identifying the waste from the characteristic; a communications unit that sends the identifying data to a remote server and that receives data in response; and an advice supply unit that delivers sorting advice to a user. The sorting advice may come from the data that was received in response and it may identify at least one of the compartments of the waste storage device into which the piece of waste should be stored or placed by the user.

13 Claims, 4 Drawing Sheets

(56) References Cited

U.S. PATENT DOCUMENTS

| | | | | |
|---|---|---|---|---|
| 2004/0199401 | A1* | 10/2004 | Wagner | B07C 7/005 235/385 |
| 2011/0036738 | A1* | 2/2011 | Hiltl | B65F 1/0046 206/459.1 |
| 2012/0010746 | A1* | 1/2012 | Sundholm | B07C 5/3412 700/226 |
| 2012/0234924 | A1 | 9/2012 | Sundholm | |

* cited by examiner

WASTE STORAGE DEVICE AND CORRESPONDING SORTING METHOD

CROSS-REFERENCE TO RELATED APPLICATIONS

This application is a U.S. National Stage application of International Application No. PCT/FR2016/050360 filed 17 Feb. 2016, which claims priority to French Application No. 1551419 filed 19 Feb. 2015.

BACKGROUND OF THE INVENTION

The present invention relates to a system for sorting waste, and to a waste sorting method that can be performed by such a system, so as to optimize the sorting of waste.

More particularly, the invention relates to a waste storage device suitable for optimizing waste sorting, and to a waste sorting method that can be performed by such a device. The invention also provides a server suitable for co-operating remotely with such a sorting device and to a control method performed by such a server.

Nowadays, sorting waste has become a daily action for very many people, both in a home context and in an industrial context, for example. The increasing volume of waste throughout the world requires effective management of waste sorting in order to facilitate recycling a maximum amount of waste and thus contribute to protecting the environment.

For this purpose, sorting rules have been established in numerous territories in order to inform everyone about how each piece of waste ought to be sorted. Nevertheless, those rules are often not well known, and they frequently give rise to users having problems of understanding how the rules ought to be applied. In addition, such sorting rules vary both in space and in time, so it is difficult for a user to know how each type of waste ought to be sorted.

The increasing complexity of packaging, in particular for home use, makes the task of sorting even more complicated.

Sometimes certain packages include sorting advice for the consumer, however the advice is not always sufficiently clearly visible and/or understandable. Furthermore, manufacturers are not generally required to apply such advice on the packaging of products. The use of such advice is also not suitable for certain types of product, in particular in the field of luxury goods.

Using sorting advice on packaging also gives rise to a problem when sorting rules are changed over time, and when products are to be distributed in various territories that apply different sorting rules.

It should also be observed that the sorting advice that sometimes appears on packaging does not give sufficient information to the user, in particular in terms of sorting and recycling.

At present, there does not exist any satisfactory solution serving in particular to mitigate the above-mentioned problems, and more generally enabling waste sorting to be optimized.

OBJECT AND SUMMARY OF THE INVENTION

To this end, the present invention provides a waste storage device comprising:

- at least two compartments suitable for storing waste;
- an acquisition unit suitable for acquiring at least one characteristic of a piece of waste that is to be stored in said waste storage device;

- a processor unit suitable for obtaining first data identifying said waste from said characteristic;
- a communications unit suitable for sending the first data to a server remote from the waste storage device and for receiving, in response to said sending, second data; and
- an advice supply unit suitable for delivering sorting advice to a user, the sorting advice being obtained from said second data, said sorting advice serving to identify at least one compartment of said waste storage device in which at least a portion of said waste should be stored.

The present invention is advantageous in that it facilitates storing waste by delivering sorting advice to users, which advice is adapted as a function of the waste to be processed. As mentioned above, sorting waste can sometimes be complex insofar as sorting rules are not always understood by users, or even known to them, and insofar as the rules can vary over time and between territories. In particular, the increasing complexity of packaging makes sorting even more difficult.

The invention enables users to be supplied with sorting advice that is pertinent, indicating in particular the compartment(s) of the garbage can in which all or part of a piece of waste should be placed.

More generally, the invention makes it possible to supply a user with any information that is useful in terms of sorting and/or managing waste or of impact on the environment.

By means of the invention, a manufacturer (e.g. of the product giving rise to the waste in question) and/or a third party organization can supply a user of the garbage can with information that is useful for enabling the user to determine how best to sort waste.

The invention makes it possible to modify sorting instructions quickly without any need to undertake an expensive awareness campaign or to apply new advice on the products themselves.

The invention serves advantageously to generate sorting advice in dynamic manner, which advice is dematerialized in centralized manner on a server suitable for communicating with at least one garbage can in accordance with the invention.

In a particular embodiment, said server is included in the waste storage device. Under such circumstances, each function of the server as defined in this document is performed by the waste storage device itself. In a particular example, the waste storage device is suitable for determining the sorting advice from the first data, e.g. by consulting a database contained in the waste storage device.

In a particular embodiment, the acquisition unit comprises at least one of the following:

- an optical acquisition device suitable for optically acquiring said characteristic of the waste by performing an optical acquisition of the waste; and
- a radiofrequency acquisition device suitable for acquiring said characteristic of the waste by radiofrequency communication with said waste.

In a particular embodiment, the optical acquisition device comprises an image acquisition device suitable for capturing an image of a graphics code appearing on the waste and for obtaining said characteristic from said image.

In a particular embodiment, the radiofrequency acquisition device comprises a radiofrequency identification (RFID) reader suitable for co-operating by radiofrequency with a radio tag associated with said waste in order to acquire said characteristic.

In a particular embodiment, the communications unit is configured to send the first data to the remote server via a first communications link set up between the communications unit and said remote server via a communications network, and for receiving the second data from the remote server via a second communications link set up between the communications unit and said remote server via said communications network.

In a particular embodiment, the advice supply unit comprises at least one of the following:

- a display screen, the advice supply unit being configured to deliver the sorting advice to the user by causing said sorting advice to be displayed on said display screen;
- a voice unit suitable for delivering the sorting advice in the form of a voice instruction; and
- at least one indicator light suitable for delivering the sorting advice in the form of a light instruction.

In a particular embodiment, the sorting advice comprises at least a first identifier of a first compartment of the waste storage device and a second identifier of a second compartment of the waste storage device that is distinct from said first compartment.

In a particular embodiment, the sorting advice comprises a first instruction identifying a first portion of the waste in association with the first identifier, and a second instruction identifying a second portion of the waste in association with the second identifier.

Correspondingly, the invention also provides a server suitable for communicating with a waste storage device as defined above in order to sort waste, the server comprising:

- a processor unit suitable for obtaining second data from first data received from the waste storage device that is situated remotely from said server, said first data identifying a piece of waste for storing in the waste storage device, said second data containing at least one piece of information enabling the waste storage device to identify at least one of its compartments in which at least a portion of said waste should be stored; and
- a communications unit suitable for sending the second data to the waste storage device in response to said first data being received.

In a particular embodiment, the information contained in the second data comprises at least a first identifier of a first compartment of the waste storage device and a second identifier of a second compartment of the waste storage device that is distinct from said first compartment.

In a particular embodiment, the information contained in the second data comprises a first instruction identifying a first portion of the waste in association with the first identifier, and a second instruction identifying a second portion of the waste in association with the second identifier.

In a particular embodiment, the processor unit of the server is suitable for obtaining location data indicative of the location of the waste storage device, and for obtaining the second data on the basis of said location data.

The invention also provides a waste sorting system comprising:

- a waste storage device as defined above; and
- a server as defined above.

The invention also provides a waste sorting method implemented by a waste storage device as defined above, the method comprising the following steps:

- acquiring at least one characteristic of a piece of waste that is to be stored in said waste storage device;
- obtaining, from said characteristic, first data identifying said waste;
- sending the first data to a server that is remote from the waste storage device;
- in response to said sending, receiving second data; and
- supplying a user with sorting advice obtained from said second data, said sorting advice serving to identify at least one compartment of said waste storage device in which at least a portion of said waste should be stored.

The embodiments and variants mentioned above with reference to the waste storage device of the invention apply in analogous manner to the waste sorting method of the invention.

In a particular embodiment, the various steps of the waste sorting method are determined by computer program. instructions.

Consequently, the invention also provides a computer program on a data medium, the program being suitable for being performed in a computer, the program including instructions adapted to perform steps of a waste sorting method as defined above.

The invention also provides a data medium (or recording medium) that is readable by a computer, and including instructions of a computer program as mentioned above.

The invention also provides a control method implemented by a server as defined above, the method comprising the following steps:

- obtaining second data from first data received from a waste storage device as defined above and situated remotely from said server, said first data identifying a piece of waste for storing in the waste storage device, wherein said second data contains at least information enabling said waste storage device to identify at least one of its compartments in which at least a portion of said waste should be stored; and
- in response to receiving said first data, sending the second data to the waste storage device.

The embodiments and variants mentioned above with reference to the server of the invention apply in analogous manner to the control method of the invention.

In a particular embodiment, the various steps of the control method are determined by computer program instructions.

Consequently, the invention also provides a computer program on a data medium, the program being suitable for being performed in a server, or more generally in a computer, the program comprising instructions adapted to performing the steps of a control method as defined above.

The invention also provides a data medium (or recording medium) that is readable by a computer, and including computer program instructions as mentioned above.

It should be observed that the programs mentioned in the present description may use any programming language, and be in the form of source code, object code, or code intermediate between source code and object code, such as in a partially compiled form, or in any other desirable form.

Furthermore, the above-mentioned data media may be any entity or device capable of storing the program. For example, the medium may comprise storage means such as a read only memory (ROM), e.g. a compact disk (CD) ROM or a microelectronic circuit ROM, or indeed magnetic recording means, e.g. a floppy disk or a hard disk.

Furthermore, the data media may correspond to a transmissible medium such as an electrical or optical signal, suitable for being conveyed via an electrical or optical cable, by radio, or by other means. The program of the invention may in particular be downloaded from an Internet type network.

Alternatively, the data media may comprise an integrated circuit in which the program is incorporated, the circuit being adapted to execute or to be used in the execution of the method in question.

BRIEF DESCRIPTION OF THE DRAWINGS

Other characteristics and advantages of the present invention appear from the following description made with reference to the accompanying drawings, which show embodiments having no limiting character. In the figures.

DETAILED DESCRIPTION OF SEVERAL EMBODIMENTS

Figure 1:
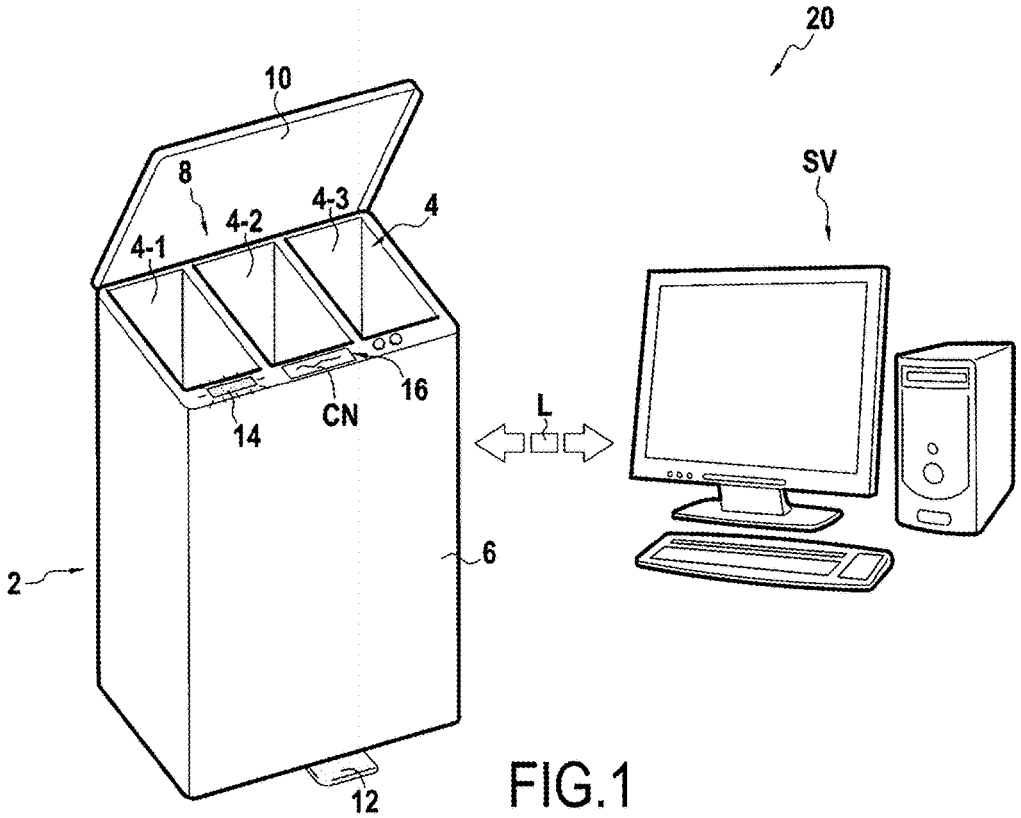
FIG. 1 is a diagrammatic general perspective view of a waste sorting system in a particular embodiment of the invention, the system comprising a garbage can and a server, each in accordance with respective particular embodiments.

As mentioned above, the present invention relates to a waste sorting system, and to a waste sorting method that can be performed by such a system so as to optimize the sorting of waste.

More particularly, the invention relates to a waste storage device suitable for optimizing waste storage, and to a waste storage method that can be performed by such a device. The invention also provides a server suitable for co-operating remotely with such a sorting device and to a control method performed by such a server.

The term "waste storage device" is used herein to designate a garbage can or the equivalent in any form whatsoever that is suitable for receiving and storing any kind of waste. In the present description, the term "can" is often used.

In the examples described below, the can of the invention is a garbage can for domestic use enabling waste to be sorted at home. Nevertheless, it should be understood that the can of the invention is equally applicable to industrial use, for example, and more generally to any type of sorting regardless of the nature of the waste in question.

Unless specified to the contrary, elements that are common or analogous in more than one of the figures are given the same references and possess characteristics that are identical or analogous, such that these common elements are generally not described again, for reasons of simplicity.

A waste sorting system 20 in a particular embodiment of the invention is described below with reference to FIGS. 1, 2, 3A, and 3B.

The waste sorting system 20 comprises a can (or waste storage device) 2 suitable for co-operating with a remote server SV via a communications link L.

The can 2 comprises a plurality of compartments (or bins), specifically three compartments 4-1, 4-2, and 4-3 (referenced collectively as 4) in this particular example. Each compartment 4 is suitable for storing waste. In this example, these compartments 4 take the form of bins arranged in the enclosure 6 of the can 2 and accessible via an opening B formed in the top face of the enclosure 6.

The structural arrangement for the can 2 as shown in FIG. 1 is merely a non-limiting embodiment. In particular, the number, the shape, and the arrangement of the compartments may vary depending on requirements, and without going beyond the ambit of the invention.

In the context of the invention, it is nevertheless necessary for the number of compartments 4 in which waste can be stored to be at least two.

Still by way of example, a panel (or door) 10 is mounted on the enclosure 6 in such a manner as to be capable of opening and closing under the action of a pedal 12 that can itself be actuated by a user. In the closed position, the panel 10 blocks access to all three compartments 4. In the open position, the panel gives the user access to the compartments 4, which user can then place waste in the chosen compartment(s). Other mechanisms for opening the can are naturally possible. Furthermore, providing a can opening mechanism is not essential for the invention.

As mentioned below in greater detail, the can 2 also has an acquisition device 14 suitable for acquiring at least one characteristic of a piece of waste, and a sorting advice supply device 16 suitable for delivering sorting advice ON to a user. In this particular example, the sorting advice ON is supplied to the user by being displayed using a display screen 16 fitted to the enclosure 6 of the can 2. As explained below and in the context of the invention, it is possible to envisage variant embodiments enabling the sorting advice ON to be supplied to the user in other ways.

The can 2, which is situated remotely from the server SV, is capable of communicating with said server via a communications link L. As mentioned below, other implementations can nevertheless be envisaged in the context of the present invention.

The can 2 is configured to deliver appropriate waste sorting advice to a user, which advice is a function of the type of each piece of waste under consideration. The sorting advice enables the user to determine the compartment (s) in which all or part of a given piece of waste should be stored. Delivering such advice serves to improve the waste sorting process considerably by providing the user with useful information about waste sorting, in particular helping the user in identifying the compartment(s) 4 in which the user is supposed to store the waste.

Figure 2:
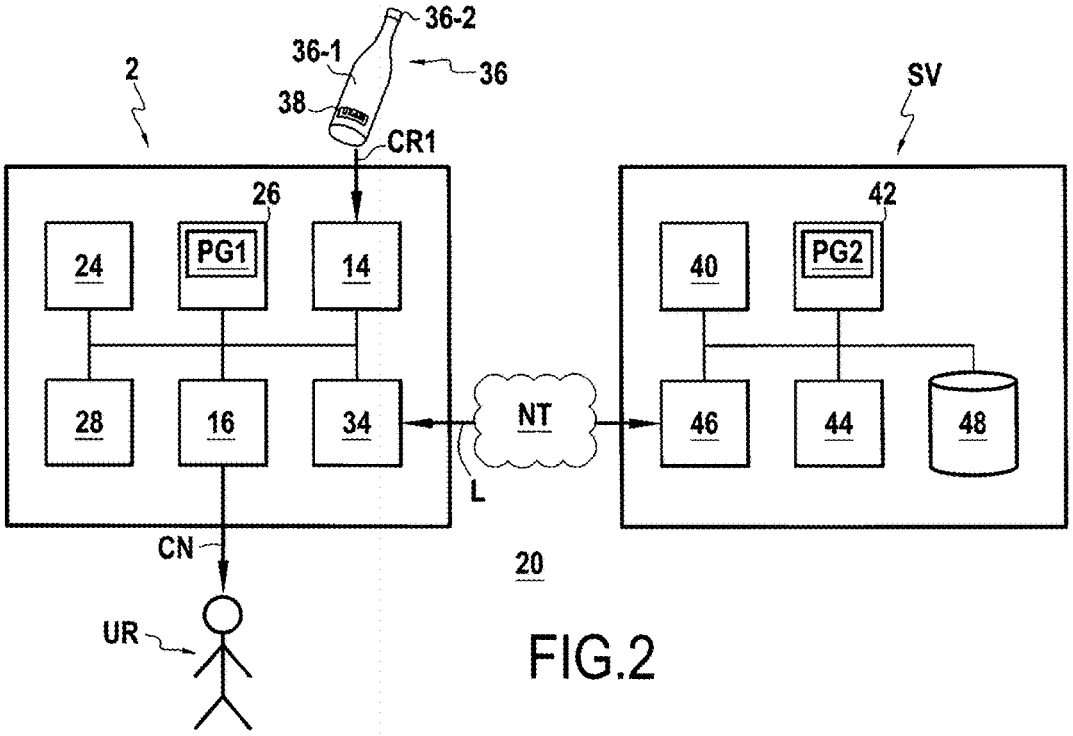
FIG. 2 is a diagram showing an example architecture for the waste sorting system shown in FIG. 1, and in particular the architecture for the garbage can and for the server of the waste sorting system.

FIG. 2 is a diagram showing the architecture of the waste sorting system 20, and in particular the can 2 and the server SV in a particular embodiment of the invention.

More particularly, the can 2 in this example includes a processor 24, a rewritable non-volatile memory 26 (e.g. of the flash type), a rewritable volatile memory or random access memory (RAM) 28, a communications interface 34, and also the acquisition device 14 and the sorting advice 16 mentioned above with reference to FIG. 1.

The flash memory 26 constitutes a data medium in accordance with a particular embodiment of the invention, which medium is readable by the processor 24 and stores a computer program PG1 in accordance with a particular embodiment of the invention.

The program PG1 includes instructions for executing steps of a waste sorting method in a particular implementation of the invention. Steps A2 to A18 of the method are shown in a particular implementation in FIG. 4, which is described below.

Alternatively, the program PG1 may be stored in a read only memory (ROM).

Consideration is given to the situation in which a user UR seeks to store a piece of waste 36 in the can 2, and more particularly in at least one of the compartments 4 of the can 2.

The piece of waste 36 under consideration may comprise only one portion (or part) that is to be thrown as a whole into one of the compartments 4, or else a plurality of portions (36-1 and 36-2 in this example) that are to be stored separately in distinct compartments 4 of the can 2. The manner in which a piece of waste is sorted (as a single part or as multiple parts) and the compartments that are to receive each part are functions of the waste sorting rules in force and in particular those rules may vary both in space and in time.

By way of example, consideration is given to a bottle 36 comprising a body 36-1 having a cap 36-2, the body 36-1 and the cap 36-2 being for storing respectively in the compartments 4-1 and 4-2 of the can 2.

As mentioned above, the acquisition device 14 is suitable for acquiring at least one characteristic (written CR1) of the piece of waste 36 that is to be stored in the can 2. This characteristic CR1 enables the waste 36 to be identified, and where appropriate enables a plurality of portions of the waste 36 to be identified. In one particular situation, the characteristic CR1 enables the piece of waste 36 to be identified uniquely, even thought that is not essential. Alternatively, the characteristic CR1 serves by way of example to identify the type of the waste 36 (e.g. waste of the "bottle" type or the "carton" type, etc.) or a category or a group of elements (product batch, . . . ) to which the piece of waste 36 belongs.

By way of example, the characteristic CR1 may comprise structural, dimensional, and/or chemical, etc. data concerning the waste, or concerning at least one specific portion of said waste. By way of example, the characteristic CR1 may comprise at least any one of the following:

- image data representing at least one image of the waste 36;
- shape data representing the shape of at least a portion of the waste 36;
- graphics data representing a graphics code that appears on the waste; and
- composition data representative of the chemical composition and/or of the material of at least a portion of the waste 36.

The characteristic CR1 may also be an identifier in any form (optical, digital, etc.).

This characteristic CFL may be acquired by the acquisition device 14 using various techniques. By way of example, the characteristic CR1 may be acquired in optical, magnetic, or radiofrequency form, or in any other form that the person skilled in the art finds appropriate in the context of the invention.

In the presently-considered example, the acquisition device 14 is an optical acquisition device suitable for acquiring the characteristic CR1 optically by performing optical acquisition of the piece of waste 36.

The optical acquisition device 14 may for example comprise a camera (or more generally an image acquisition device) suitable for acquiring as the characteristic CR1 at least one image of all or a portion of the waste 36. Under such circumstances, the characteristic CR1 is in the form of image data for the image acquired by the camera.

In a particular embodiment, the optical acquisition device 14 is suitable for performing shape recognition on the basis of the piece of waste 36. On the basis of this shape recognition, the optical acquisition device 14 generates shape data as the characteristic CR1, which shape data is representative of the shape of the waste 36.

In the presently-considered example, the waste 36 carries a graphics code (a bar code or 1D code, or indeed a 2D code, for example). Typically, the graphics code appears on the body of the waste. The optical acquisition device 14 is suitable for reading the graphics code and for deducing graphics data therefrom, which data then constitutes the characteristic CR1.

In another alternative, the acquisition device 14 is a radiofrequency acquisition device suitable for acquiring the characteristic CR1 of the waste by radiofrequency communication with the waste 36. By way of example, the acquisition device 14 comprises an RFID reader suitable for radiofrequency co-operation with a radio tag associated with the waste 36 so as to acquire the characteristic CR1. Such a radio tag is typically fastened to the waste 36 so that when it is in the action zone of the RFID reader it sends RFID data to said RFID reader.

In the light of the above, can be understood that various techniques may be envisaged in the context of the invention for acquiring the characteristic CR1 of the waste under consideration, providing that the characteristic CR1 as obtained in this way enables the waste 36 (or several portions of the waste 36) to be identified in order to perform the waste sorting method of the invention, as described in detail below. In an alternative, the acquisition device 14 performs a plurality of distinct techniques for acquiring the characteristic CR1.

It can be understood that the characteristic CR1 may comprise multiple items of data enabling the waste 36 to be identified as a whole.

As mentioned above, the can 2 also has a (sorting) advice supply device 16 suitable for delivering sorting advice, written CN, to a user. The sorting advice CN enables a user UR to identify at least one compartment 4 of the can 2 into which all or part of the piece of waste 36 should be stored. For this purpose, the sorting advice comprises at least one identifier of a compartment 4 into which at least a portion of the waste 36 should be thrown. The term "identifier" of a compartment is used herein to specify any information that can be presented to a user and on the basis of which the user can identify the compartment in which all or part of a piece of waste should be stored. Non-limiting examples of compartment identifiers in the meaning of the invention are described below.

In a variant embodiment, the sorting advice CN comprises at least a first identifier of a first compartment (e.g. 4-1) and a second identifier of a second compartment (e.g. 4-2) that is different from the first compartment.

In the presently-considered embodiment, the advice supply device 16 is a display screen suitable for displaying the sorting advice ON on command from the processor 24. Other embodiments of the advice supply device 16 can nevertheless be envisaged.

Alternatively, the advice supply device 16 may be a voice device suitable for delivering the sorting advice CN to the user UR in the form of a voice instruction. The advice supply device 16 may also comprise at least one indicator light (or the equivalent) suitable for delivering the sorting advice ON in the form of a light instruction.

In a variant, the advice supply device 16 may make use of at least one of the alternatives mentioned above for supplying the sorting advice to the user.

The can 2 also has an interface 34 enabling the can 2 to communicate via the communications link L with the server SV. In this example, the link L is set up via a communications network NT. The network NT may be the Internet, or it may be an Intranet, for example. In a particular example, the can 2 is connected to a router (preferably by WiFi), the router acting as the interface with the network NT.

In a variant embodiment, the interface 34 is included in the processor 24.

Figure 3A:
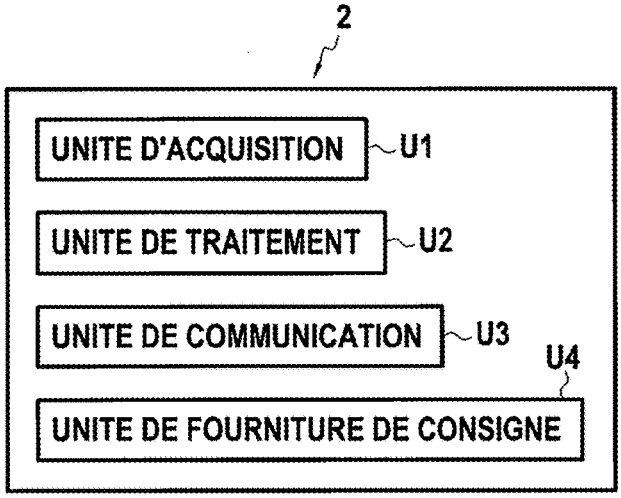
FIG. 3A is a diagram showing units used by the garbage can shown in FIG. 1 to perform a waste sorting method in a particular implementation.

For a particular embodiment, FIG. 3A shows a set of units used by the can 2 to perform the waste sorting method. As shown in FIG. 3A, the can 2 thus has an acquisition unit U1, a processor unit U2, a communications unit U3, and an advice supply unit U4.

The acquisition unit U1 is suitable for acquiring said at least one characteristic CR1 of the waste 36 that is to be stored in the can 2. The acquisition unit U1 in this example is used by the processor 24 and by the acquisition device 14. In a variant, the acquisition unit U1 is used solely by the acquisition device 14.

The processor unit U2 is suitable for obtaining first data DN1 identifying the waste 36 from the characteristic CR1 acquired by the unit U1. In order to do this and by way of example, the processor unit U2 may perform any kind of processing on the basis of the characteristic CR1 in order to obtain the data DN1. Depending on requirements, the person skilled in the art can decide if necessary what processing needs to be implemented in order to obtain appropriate data DN1 serving to identify the waste 36. By way of example, the processing may rely on image processing when the characteristic CR1 comprises image data and/or shape data.

Nevertheless, such processing is not essential for performing the invention. In one particular situation, the data DN1 is identical to the characteristic CR1. In other words, the characteristic CR1 acquired by the acquisition unit U1 is the data DN1. In this situation, the acquisition unit U1 and the processor unit U2 form a single unit.

In the presently-considered example, the processor unit U2 is used by the processor 24.

The communications unit U3 is suitable for sending the first data DN1 to the remote server SV, and in response to sending this data, it is suitable for receiving second data DN2. By way of example, the second data DN2 as received in this way comes from the server SV. Alternatively, the second data DN2 may be sent by some other entity on command from the server SV.

In this example, the communications unit U3 is used by the processor 24 and by the interface 34.

More precisely, the communications unit U3 may be configured to send the first data DN1 to the server SV over a first communications link set up between the communications unit U3 and the server SV over the communications network NT, and to receive the second data DN2 from the remote server SV via a second communications link set up between the communications unit U3 and the server SV via the communications network NT. These first and second links may comprise a single communications link L or two communications links that are set up one after the other.

The advice supply unit U4 is suitable for supplying the user UR with sorting advice ON obtained from the second data DN2, said sorting advice ON enabling the user UR to identify at least one compartment 4 of said waste storage device 2 in which at least a portion of said waste 36 should be stored. To do this and by way of example, any kind of processing may be performed on the basis of the second data DN2 in order to obtain the sorting advice ON. As a function of requirements, the person skilled in the art can decide if necessary what processing needs to be performed in order to obtain the appropriate sorting advice ON serving to identify at least one compartment 4 into which a piece of waste is to be placed. Nevertheless, such processing is not essential for performing the invention. In one particular situation, the sorting advice ON is identical to the second data DN2. In other words, the second data DN2 as received by the communications unit U3 is the sorting advice ON.

As shown in FIG. 2, the server SV also has a processor 40, a rewritable non-volatile memory 42 (e.g. of the flash type), a rewritable volatile memory (or RAM) 44, a communications interface 46, and a database 48.

The flash memory 42 constitutes a data medium in accordance with an embodiment of the invention, which medium is readable by the server SV and stores a computer program PG2 in accordance with a particular embodiment of the invention. The program PG2 includes instructions for executing steps of a control method in a particular implementation of the invention. The steps B6 to B14 of this method are shown in a particular implementation of the invention in FIG. 4, which is described below.

The communications interface 46 enables the server SV to communicate with the can 2 via the network NT.

In this example, the database contains data enabling the server to determine the second data DN2 on the basis of the first data DN1. Alternatively, the database 48 may be situated outside the server SV, with the server being suitable for communicating remotely with the database 48.

Figure 3B:
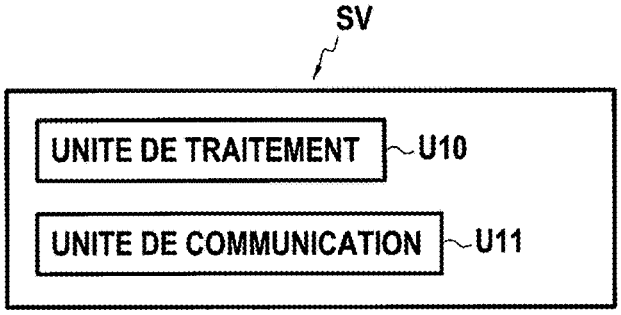
FIG. 3B is a diagram showing units used by the server shown in FIG. 1 for performing a control method in a particular implementation.

In a particular embodiment, FIG. 3B shows a set of units used by the server SV to implement the control method. As shown in FIG. 3B, the server SV comprises a processor unit U10 and a communications unit U11.

The processor unit U10 is suitable for obtaining the second data DN2 from the first data DN1 as received from the can 2, this first data DN1 identifying the waste 36 that is to be stored in the can. For this purpose, the processor unit U10 may perform any kind of processing on the basis of the first data DN1 in order to obtain the second data DN2. In the presently-considered example, the processing performed by the processor unit U10 comprises in particular consulting the database 48 in order to obtain the data DN2 from the data DN1. Nevertheless, other implementations can be envisaged.

In this example, the processor unit U10 is used by the processor 40 in co-operation with the database 48.

The communications unit U11 is suitable for sending the second data DN2 as obtained in this way to the can 2 in response to the received first data DN1. In this particular example, the communications unit U11 is used by the processor 40 and by the communications interface 46.

In a particular example, the second data DN2 contains at least information enabling the can 2 to identify at least one of its compartments 4 into which at least a portion (36-1, 36-2) of the waste 36 is to be stored.

In a particular example, the second data DN2 thus comprises at least one identifier of a first compartment (e.g. 4-1) of the can 2 and a second identifier of a second compartment (e.g. 4-2) of the can 2 that is distinct from said first compartment.

In a particular example, the second data DN2 comprises more particularly a first instruction identifying a first portion of the waste (36-1) in association with the first identifier, and a second instruction identifying a second portion of the waste (36-2) in association with the second identifier.

Furthermore, in the presently-considered example, the server SV is an entity that is remote from the can 2, a communications link L being set up (e.g. via the network. NT) so as to enable remote communication between the bin 2 and the server SV. In a variant embodiment each function specific to the server SV in the context of the invention is performed in the can 2 itself. In other words, in this variant, the can 2 (and more particularly the processor 24 controlled by the program PG1, for example) also makes use locally of the modules U10 and U11 shown in FIG. 3B. In this example, the can 2 is suitable in particular for determining the second data DN2 on the basis of the first data DN1 and then for determining the sorting advice ON on the basis of the second data DN2. In a particular example, the data DN2 is identical to the data DN1 and the can 2 is configured to determine the sorting advice ON directly from the first data DN1, e.g. by consulting a database 48 as described below with reference to FIG. 4. In one particular situation, this database 48 is contained within (or forms a part of) the can 2. By way of example, the can 2 may be suitable for updating the content of the database 48, where necessary, e.g. by co-operating with a remote server.

Implementations of the waste sorting method performed by the can 2 and of the control method performed by the server SV are described below with reference to FIGS. 4 to 7. For this purpose, the can 2 executes the computer program PG1 and the server SV executes the computer program PG2.

In the presently-described example, consideration is given to the situation in which the user UR seeks to place a piece of waste 36 in the can 2. It is assumed that in accordance with the sorting rules in force, the body 36-1 of the bottle 36 is to be placed in the compartment 4-1 and the cap 36-2 is to be placed in the compartment 4-2.

During a step A2, the acquisition unit U1 acquires at least one characteristic CR1 of the waste 36. As explained above, the form in which this characteristic CR1 is obtained and the way in which such a characteristic CR1 is obtained may vary depending on circumstances.

Figure 5:
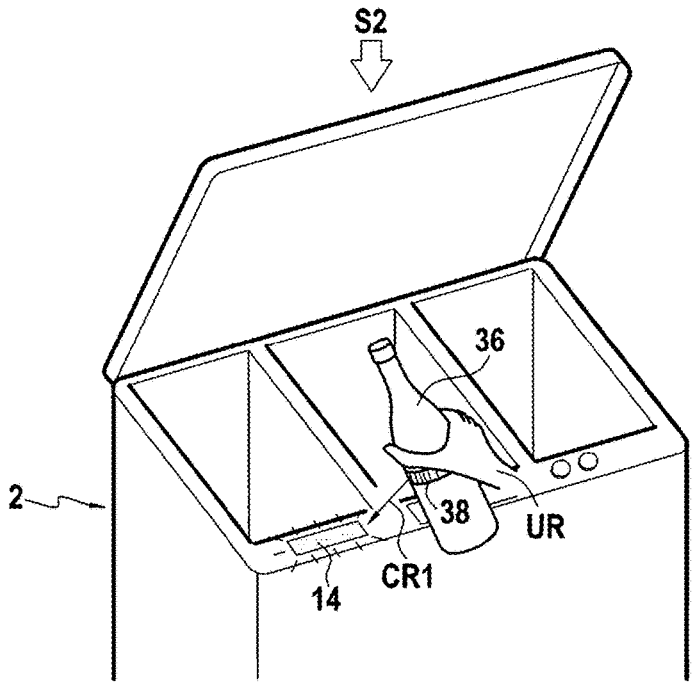
FIG. 5 is a diagram showing a characteristic of a piece of waste being acquired by the garbage can shown in FIG. 1.

In this example it is assumed that the acquisition device 14 is of the optical type and comprises a camera (or more generally an image acquisition device), as described above. The user UR places the waste 36 in front of the camera so that the camera captures (A2) an image of the graphics code 38 (a 1D code or bar code, a 2D code, etc.) that appears on the body of the waste 36 (FIG. 5). The acquisition device 14 thus acquires the characteristic CR1 in the form of image data (or graphics data) representative of the graphics code 38 that identifies the waste 26. As described above, the characteristic CR1 may be acquired in other forms.

On the basis of the characteristic CR1, the processor unit U2 obtains (A4) the first data DN1 identifying the waste 36. In one particular situation, as mentioned above, the first data DN1 is identical to the characteristic CR1.

Figure 6:
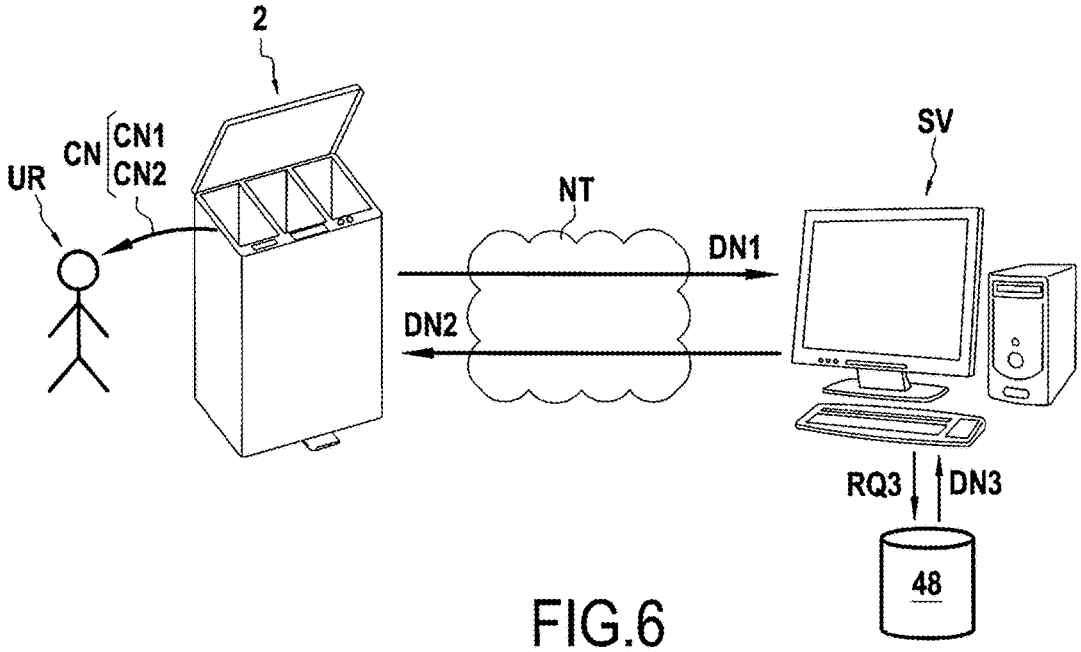
FIG. 6 is a diagram showing interactions that take place between the various elements of the waste sorting system while performing the waste sorting method and the control method, in a particular implementation of the invention.

The communications unit U3 of the can 2 then sends (A6) the first data DN1 to the remote server SV via the communications link L (FIG. 6).

The server SV, and more particularly its processor unit U10, then determines (B8-B12) the second data DN2 on the basis of the first data DN1 that it has received (B6). More precisely, in the presently-considered example, the first processor unit U10 sends (B8) a request RQ3 to the database 48, the request containing the first data DN1 (or data obtained on the basis of the first data DN1), and in return it receives (B10) data DN3 supplied by the database 48.

By way of example, the database 48 contains a list of data items DN3, referred to as "third" data items, in correspondence with first data items DN1. On the basis of the first data DN1 supplied by the can 2, the server SV recovers the corresponding third data DN3 from the database 48 so that the remote server SV can deduce the appropriate second data DN2 therefrom.

Typically, said third data DN3 contained in the database 48 is supplied in declarative manner by the manufacturers of each product that might be thrown into the can 2, although other implementations can nevertheless be envisaged. By way of example, for each bar code in circulation, items of third data DN3 are associated therewith serving to determine how the corresponding product should be sorted.

Thereafter, the processor unit U10 obtains (B12) the second data DN2 from the third data DN3 that it has recovered (B10). In the above-mentioned particular situation, the third data DN3 is identical to the second data DN2.

The communications unit U11 acts during a step B14 to send the second data DN2 to the can 2 (FIG. 6).

Once the second data DN2 has been received (A4), the can 2 uses the second data DN2 to determine (A16) sorting advice CN, as explained above. This determination may be performed by the advice supply unit U4 or by some other processor unit (not shown) used by the processor 24 of the can 2. In a particular example, the second data DN2 is not directly understandable and presentable as such to the user UR. Under such circumstances, processing may be performed on the basis of the data DN2 in order to obtain the sorting advice CN.

In a particular situation as mentioned above, the sorting advice CN is identical to the second data DN2. In other words, in this particular situation, the second data DN2 as received by the can 2 in step A14 is the sorting advice CN.

The sorting advice CN enables the user UR to identify at least one compartment 4 of the can 2 in which at least a portion of the waste 36 is to be stored.

During a step A18, the advice supply unit U4 delivers the sorting advice CN to the user UR, as obtained from the second data DN2. In the presently-considered example, the advice supply device 16 is a display screen that displays the sorting advice ON. As mentioned above and in the context of the invention, several variants may be envisaged for supplying the advice ON to the user UR.

In one variant, the advice ON may be delivered to the user UR by way of example by the advice supply device 16 using at least one of the following techniques:

- in visual form, using a display screen and/or indicator lights (LEDs, etc.); and
- in voice form using a voice device.

In the particular situation of a display on a screen, the sorting advice ON may be in the form of alphanumeric characters or any other symbols that can be understood by a user.

As explained above, the sorting advice ON includes at least one identifier of a compartment 4 of the can 2. In other words, the sorting advice ON enables the user UR to identify at least one of the compartments 4-1 to 4-3 in which all or a portion of the waste 36 is to be placed.

By way of example, an identifier of a compartment 4 may be in the form of at least one symbol that can be understood by the user UR (a number or a name specific to each compartment) or in the form of at least one pattern of a color that identifies the corresponding compartment 4.

By way of example, sorting advice CN displayed on the screen may comprise the term "RIGHT-HAND BIN" or "BIN 2" to identify a particular compartment 4. Alternatively, when a compartment 4 is to receive recyclable substances, for example, the sorting advice ON may say "RECYCLE" to indicate that the waste in question should be placed in the said compartment for recyclable substances.

When the sorting advice CN is given in voice form, the sorting advice ON may indicate vocally the position of the appropriate compartment (left, right, . . . ), or a name, or a color, or any other convention enabling the user to identify a particular compartment 4.

In a particular embodiment, the sorting advice ON comprises at least two identifiers for two distinct compartments 4 of the can 4. On the basis of this sorting advice ON, the user UR is capable of determining the corresponding compartments 4 in which different portions of the waste 36 (or of multiple pieces of waste) are to be placed.

In the presently-envisaged example, the sorting advice ON comprises the identifiers ID1 and ID2 of the compartments 4-1 and 4-2, respectively. The advice CN informs the user UR that one portion of the waste 36 is to be placed in the compartment 4-1 and another portion of the waste 36 is to be placed in the compartment 4-2. It should be observed that it is not essential for the advice CN also to indicate which portion of the waste 36 is to be placed in each of the two compartments 4-1 and 4-2.

In a variant embodiment, in addition to the identifiers ID1 and ID2, for example, the sorting advice CN contains instructions identifying the portion(s) of the waste 36 that is/are to be placed in each of the compartments corresponding to IDI and ID2 (i.e. 4-1 and 4-2).

As described below with reference to FIG. 7, the sorting advice CN in a particular embodiment comprises a first instruction CN1 identifying a first portion of the waste (36-1) in association with the first identifier ID1, and a second instruction CN2 identifying a second portion of the waste (36-2) in association with the second identifier ID2.

As mentioned above, the second data DN2 sent by the server SV in step B14 contains at least information enabling the can 2 to identify at least one of its compartments 4 in which at least a portion (36-1, 36-2) of said waste 36 is to be stored.

In a particular example, the second data DN2 sent in step B14 by the server SV comprises at least the first identifier ID1 of a first compartment (e.g. 4-1) of the can 2 and the second identifier ID2 of a second compartment (e.g. 4-2) that is distinct from the first compartment 4-1. The second data DN2 thus enables the can 2 to determine, in step A16, sorting advice CN comprising at least two identifiers of compartments in which portions of a piece of waste 36 are to be placed.

In a particular example, the second data DN2 comprises more particularly the first instruction CN1 identifying a first portion 36-1 of the waste 36 in association with the first identifier ID1, and the second instruction CN2 identifying a second portion 36-2 of the waste 36 in association with the second identifier 1D2. Under such circumstances, the can 2 can then determine, in step A16, sorting advice CN that comprises the instructions CN1 and CN2.

The sorting advice CN may also include various instructions that are of use for the user UR when performing the sorting process and, more generally, in the user's approach to recycling and managing waste. The information included in the sorting advice CN is selected so as to be pertinent for the user, and preferably in association with the piece of waste 36 that is to be thrown away.

The present invention is advantageous in that it makes sorting waste easier by giving sorting advice to users that is adapted as a function of the waste that is to be processed. As mentioned above, the sorting of waste is sometimes complex insofar as sorting rules are not always well understood by users or even known to them, and the rules can vary in time and between territories. In particular, the increasing complexity of packaging makes sorting even more difficult.

The invention makes it possible to give sorting advice to users that is pertinent, indicating in particular the compartment(s) in the can into which part or all of a piece of waste should be placed.

More generally, the invention makes it possible to supply the user with any information that is useful in terms of sorting and managing waste or of impact on the environment.

By means of the invention, a manufacturer (e.g. of the product giving rise to the waste in question) and/or a third party organization can supply the user of the can with information that is useful for enabling the user to determine how best to sort waste.

The invention makes it possible to modify sorting instruction quickly without any need to undertake an expensive awareness campaign or to apply new advice on the products themselves.

The invention serves advantageously to generate sorting advice in dynamic manner, which advice is dematerialized in centralized manner on a server that is suitable for communicating with at least one can in accordance with the invention.

In a particular embodiment, the sorting advice CN comprises at least two instructions, each identifying a portion of the waste 36 in association with an identifier of a distinct compartment 4 of the can 2.

Figure 7:
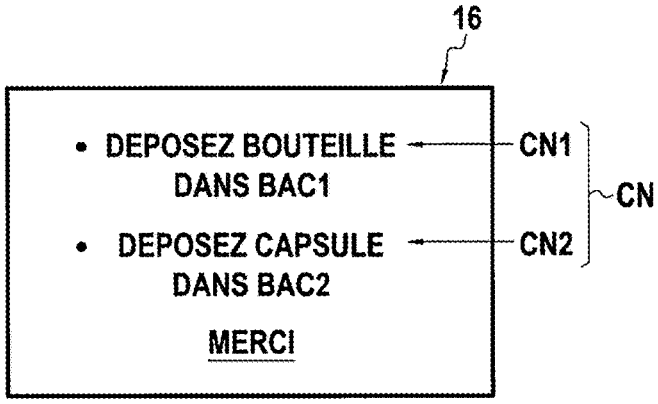
FIG. 7 shows sorting advice as delivered to a user by the garbage can shown in FIG. 1, in a particular embodiment of the invention.

For example, in the situation shown in FIG. 7, the sorting advice CN comprises a first instruction CN1 ("PUT BOTTLE IN BIN1") indicating that the first portion 36-1 of the waste 36 should be stored in the first compartment 4-1, and a second instruction CN2 ("PUT CAP IN BIN2") indicating that the second portion 36-2 of the waste 36 should be stored in the second compartment 4-2.

This embodiment is advantageous in that it provides an effective solution for sorting complex products comprising a plurality of portions that should be placed in different compartments of the can.

Still by way of example, the sorting advice CN may be presented as follows:

"Recycle Bottle—Throw Away Cap"

In this particular example, the term "RECYCLE" identifies a compartment 4 dedicated to recyclable waste and the term "THROW AWAY" identifies another compartment 4 dedicated to non-recyclable waste. This sorting advice CN associates the identifier "BOTTLE" with the compartment 4 that is for recyclable waste and associates the identifier "CAP" with the compartment 4 that is for non-recyclable waste. This advice consequently invites the user UR to throw away the body 36-1 of the bottle in the compartment 4 that is for recyclable waste and to throw away the cap 36-2 in the compartment 4 that is for non-recyclable waste. Such advice is particularly appropriate when only two distinct compartments 4 are present in the can 2, but variants can be envisaged for a can that has more than two compartments.

In a variant embodiment, the can 2 acts in a step A6 to send an identifier of the can 2 to the server SV. The server SV then determines (B12) the second data DN2 on the basis of the first data DN1 (or more precisely on the basis of the third data DN3 obtained in step B10 in this example) and on the basis of the identifier of the can that it has received. By way of example, the identifier of the can 2 is its media access control (MAC) identifier.

This variant makes it possible to adapt the sorting advice to the model or the type of the can 2. By way of example, the sorting advice may be adapted as a function of the number of compartments and of the intended use for each compartment of the can.

In a variant embodiment, the second data DN2 supplied in step B14 by the server SV is also a function of the location of the can 2 at which the acquisition A2 was performed.

Figure 4:
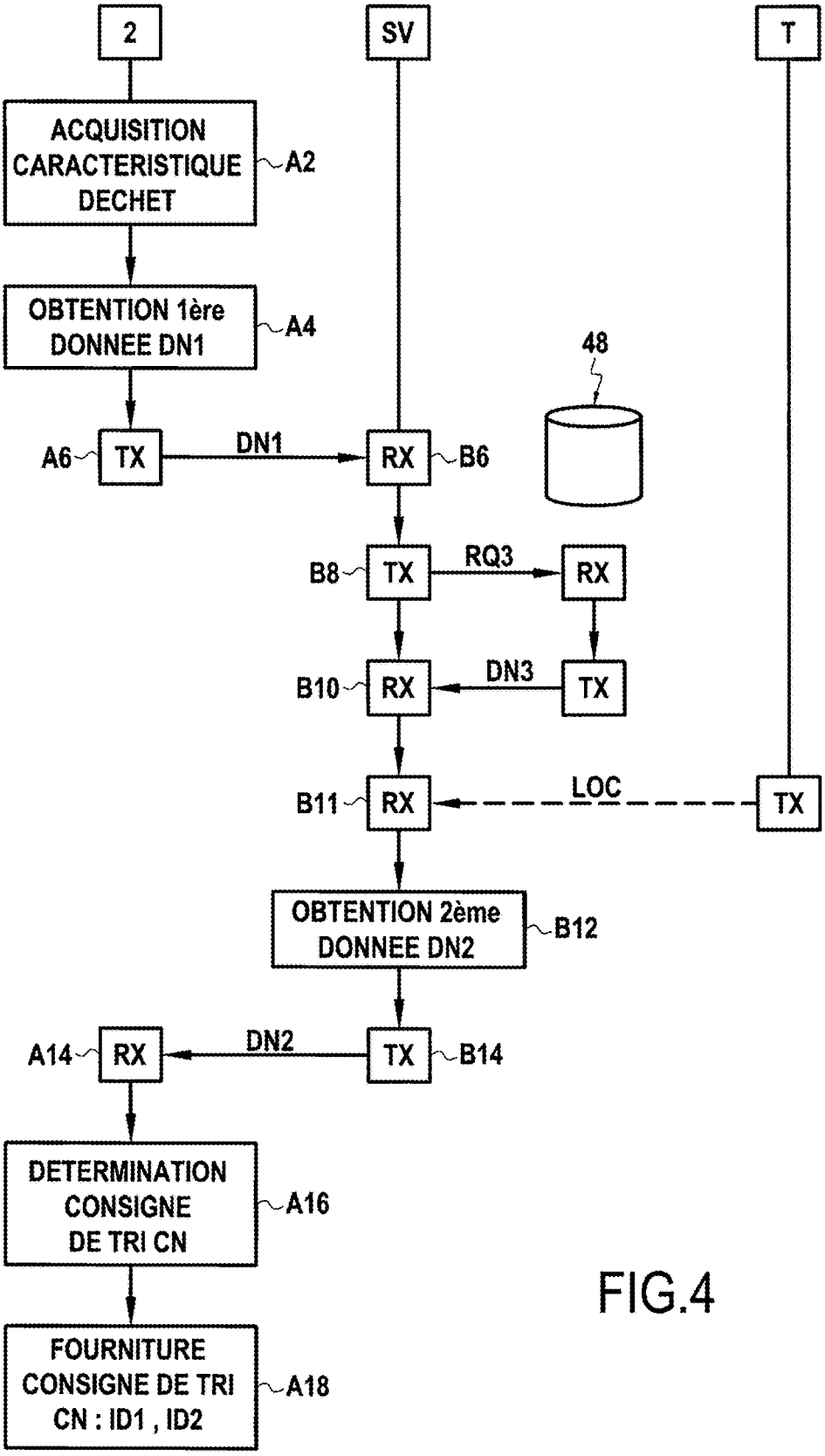
FIG. 4 is a flow chart showing steps of a waste sorting method and of a control method performed respectively by the garbage can and by the server shown in FIG. 1, in a particular implementation of the invention.

In a particular example, it is assumed that a terminal T, external to the server SV and to the can 2, sends location data LOC to the server SV, which receives it in step B11 (FIG. 4). This data LOC is representative of the location of the can 2. The server then determines (B12) the second data DN2 on the basis of the first data DN1 (or more precisely of the third data DN3 as obtained in step BID in this example) and on the basis of the location data LOC.

This variant makes it possible advantageously to adapt the second data DN2 supplied to the can 2, and thus the sorting advice CN delivered thereafter to the user UR, as a function of the location of the can 2. This variant is particularly useful when it is necessary to apply different sorting rules as a function of the location in which the can in question is to be found.

For example, it is possible to envisage that the user or a third party supplies the data LOC in declarative manner by using the terminal T. This information may for example be supplied before the step A2 or before the step B11. In a particular example, the user UR supplies information relating to the location of the can by using an application that runs on the terminal T.

In a variant, the can sends (e.g. in step AG) an identifier of the can 2 to the server SV. Thereafter, the server SV obtains the data LOC from the identifier of the can 2 (e.g. by communicating with the terminal T). By way of example, the identifier of the can 2 is its internet protocol (IP) address (sent by the can or by a router connected to the can) on the basis of which the server SV can recover the location data LOC.

In another variant, the can 2 sends (e.g. in step AG) the information LOC directly to the server SV. Under such circumstances, the terminal T is the can 2.

The person skilled in the art will understand that the above-described embodiments and variants merely constitute non-limiting examples of how the invention may be implemented. In particular, the person skilled in the art can envisage any combination of the variants and embodiments that are described above in order to satisfy any particular need.

The invention claimed is:

1. A waste storage device comprising:

at least two compartments suitable for storing waste;

an acquisition unit that acquires at least one characteristic of waste that is to be stored in said waste storage device;

a processor unit that obtains first data identifying said waste from said at least one characteristic;

a communications unit that sends the first data to a server that is remote from the waste storage device and for receiving, in response to said sending, second data; and an advice supply unit that delivers sorting advice to a user, the sorting advice being obtained from said second data, said sorting advice serving to identify at least one compartment of said at least two compartments in which at least a portion of said waste should be stored, the sorting advice comprising at least a first identifier of a first compartment among the at least two compartments of the waste storage device and a second identifier of a second compartment among the at least two compartments of the waste storage device that is distinct from said first compartment, the sorting advice comprising a first instruction identifying a first portion of the waste in association with the first identifier, and a second instruction identifying a second portion of the waste in association with the second identifier.

2. The device according to claim 1, wherein the acquisition unit comprises at least one of the following:

an optical acquisition device that optically acquires said characteristic of the waste by performing an optical acquisition of the waste; and a radiofrequency acquisition device that acquires said characteristic of the waste by radiofrequency communication with said waste.

3. The device according to claim 2, wherein the optical acquisition device comprises an image acquisition device suitable for capturing an image of a graphics code appearing on the waste and for obtaining said characteristic from said image.

4. The device according to claim 2, wherein the radiofrequency acquisition device comprises an RFID reader that cooperates by radiofrequency with a radio tag associated with said waste in order to acquire said characteristic.

5. The device according to claim 1, wherein the communications unit sends the first data to the server via a first communications link set up between the communications unit and said server via a communications network, and receives the second data from the server via a second communications link set up between the communications unit and said server via said communications network.

6. The device according to claim 1, wherein the advice supply unit comprises at least one of the following:

a display screen, the advice supply unit being configured to deliver the sorting advice to the user by causing said sorting advice to be displayed on said display screen;

a voice unit suitable for delivering the sorting advice in the form of a voice instruction; and at least one indicator light suitable for delivering the sorting advice in the form of a luminous instruction.

7. A server that communicates with a waste storage device according to claim 1 in order to sort waste, the server comprising:

a processor unit that obtains second data from first data received from the waste storage device that is situated remotely from said server, said first data identifying waste for storing in the waste storage device, said second data containing at least one piece of information enabling the waste storage device to identify at least one of its compartments in which at least a portion of said waste should be stored; and a communications unit that sends the second data to the waste storage device in response to said first data being received, the information contained in the second data comprising at least a first identifier of a first compartment of the waste storage device and a second identifier of a second compartment of the waste storage device that is distinct from said first compartment, the information contained in the second data comprising a first instruction identifying a first portion of the waste in association with the first identifier, and a second instruction identifying a second portion of the waste in association with the second identifier.

8. The server according to claim 7, wherein the processor unit of the server obtains location data indicative of the location of the waste storage device, and obtains the second data on the basis of said location data.

9. A waste sorting system comprising:

a waste storage device comprising:

at least two compartments suitable for storing waste;

an acquisition unit that acquires at least one characteristic of waste that is to be stored in said waste storage device;

a first processor unit that obtains first data identifying said waste from said at least one characteristic;

a first communications unit that sends the first data to a server that is remote from the waste storage device and that receives, in response to said sending, second data; and an advice supply unit that delivers sorting advice to a user, the sorting advice being obtained from said second data, said sorting advice serving to identify at least one compartment of said at least two compartments in which at least a portion of said waste should be stored; and a server comprising:

a second processor unit that obtains the second data from the first data received from the waste storage device, said first data identifying the waste for storing in the waste storage device, said second data containing at least one piece of information enabling the waste storage device to identify at least one of its compartments in which at least a portion of said waste should be stored; and a second communications unit that sends the second data to the waste storage device in response to said first data being received, the sorting advice comprising at least a first identifier of a first compartment among the at least two compartments of the waste storage device and a second identifier of a second compartment among the at least two compartments of the waste storage device that is distinct from said first compartment, the sorting advice comprising a first instruction identifying a first portion of the waste in association with the first identifier, and a second instruction identifying a second portion of the waste in association with the second identifier.

10. A waste sorting method implemented by a waste storage device according to claim 1, the method comprising:

acquiring at least one characteristic of waste that is to be stored in said waste storage device;

obtaining, from said at least one characteristic, first data identifying said waste;

sending the first data to a server that is remote from the waste storage device;

in response to said sending, receiving second data; and supplying a user with sorting advice obtained from said second data, said sorting advice serving to identify at least one compartment of said waste storage device in which at least a portion of said waste should be stored, the sorting advice comprising at least a first identifier of a first compartment among the at least two compartments of the waste storage device and a second identifier of a second compartment among the at least two compartments of the waste storage device that is distinct from said first compartment, the sorting advice comprising a first instruction identifying a first portion of the waste in association with the first identifier, and a second instruction identifying a second portion of the waste in association with the second identifier.

11. A non-transitory computer-readable medium including instructions, that when executed by a computer, perform a method comprising:

acquiring at least one characteristic of waste that is to be stored in a waste storage device;

obtaining, from said at least one characteristic, first data identifying said waste;

sending the first data to a server that is remote from the waste storage device;

in response to said sending, receiving second data; and supplying a user with sorting advice obtained from said second data, said sorting advice serving to identify at least one compartment of said waste storage device in which at least a portion of said waste should be stored, the sorting advice comprising at least a first identifier of a first compartment among the at least two compartments of the waste storage device and a second identifier of a second compartment among the at least two compartments of the waste storage device that is distinct from said first compartment, the sorting advice comprising a first instruction identifying a first portion of the waste in association with the first identifier, and a second instruction identifying a second portion of the waste in association with the second identifier.

12. A control method implemented by a server according to claim 7, the method comprising:

obtaining the second data from the first data received from the waste storage device that is situated remotely from said server, said first data identifying the waste for storing in the waste storage device, wherein said second data contains at least information enabling said waste storage device to identify at least one of its compartments in which at least a portion of said waste should be stored; and in response to receiving said first data, sending the second data to the waste storage device.

13. A non-transitory computer readable medium that includes instructions that, when executed by a computer, perform the control method according to claim 12.

* * * * *